US010876529B2

(12) United States Patent
Hwang

(10) Patent No.: US 10,876,529 B2
(45) Date of Patent: Dec. 29, 2020

(54) CENTRIFUGAL SUCTION-TYPE HYBRID VANE FLUID MACHINE

(71) Applicant: Kwang-Seon Hwang, Jeonju-si (KR)

(72) Inventor: Kwang-Seon Hwang, Jeonju-si (KR)

( * ) Notice: Subject to any disclaimer, the term of this patent is extended or adjusted under 35 U.S.C. 154(b) by 221 days.

(21) Appl. No.: 16/079,973

(22) PCT Filed: Feb. 20, 2017

(86) PCT No.: PCT/KR2017/001839
§ 371 (c)(1),
(2) Date: Aug. 24, 2018

(87) PCT Pub. No.: WO2017/150833
PCT Pub. Date: Sep. 8, 2017

(65) Prior Publication Data

US 2019/0063435 A1 Feb. 28, 2019

(30) Foreign Application Priority Data

Mar. 4, 2016 (KR) ..... 10-2016-0026096

(51) Int. Cl.
*F01C 1/00* (2006.01)
*F03C 2/00* (2006.01)
(Continued)

(52) U.S. Cl.
CPC ..... *F04C 29/0021* (2013.01); *F01C 1/32* (2013.01); *F04C 2/324* (2013.01); *F04C 18/324* (2013.01); *F04C 29/00* (2013.01); *F04C 29/02* (2013.01)

(58) Field of Classification Search
CPC ..... F04C 29/00; F04C 29/02; F04C 29/0021; F04C 18/324; F04C 18/3566; F04C 2/067;
(Continued)

(56) References Cited

U.S. PATENT DOCUMENTS 4,354,809 A * 10/1982 Sundberg ..... F01C 21/0863 418/268
4,728,272 A * 3/1988 Simonsen ..... F04C 2/348 418/260
(Continued)

FOREIGN PATENT DOCUMENTS

JP S60-164690 A 8/1985
JP H06-000368 U 1/1994
(Continued)

OTHER PUBLICATIONS

KR Office Action dated Aug. 17, 2016 as received in Application No. 10-2016-0026096.
(Continued)

*Primary Examiner* — Theresa Trieu
(74) *Attorney, Agent, or Firm* — Maschoff Brennan

(57) ABSTRACT

The present invention relates to a centrifugal suction-type hybrid vane fluid machine and, more particularly, to a centrifugal suction-type hybrid vane fluid machine wherein a cam ring, which rotates inside a compressor, has a plurality of final intake openings formed through the same from the inner peripheral edge to the outer peripheral edge thereof, thereby facilitating inflow of a fluid during rotation; an oil passage is formed therein so as to seal inner constituent elements and to apply a backpressure of vanes, thereby preventing leakage of the fluid and reducing friction; the same number of initial fluid discharge openings are formed as that of the vane or fluid chambers, thereby improving the efficiency of the compressor; and the cam ring is installed eccentrically so as to increase the rotational contact force, thereby improving the efficiency of the compressor while having all advantages of conventional compressors.

5 Claims, 4 Drawing Sheets

(51) Int. Cl.

| | |
|---|---|
| ***F03C 4/00*** | (2006.01) |
| ***F04C 2/00*** | (2006.01) |
| ***F04C 29/00*** | (2006.01) |
| ***F04C 2/324*** | (2006.01) |
| ***F04C 18/324*** | (2006.01) |
| ***F04C 29/02*** | (2006.01) |
| ***F01C 1/32*** | (2006.01) |

(58) Field of Classification Search

CPC ..... F04C 2/324; F04C 2/3566; F01C 1/32; F01C 21/0836; F01C 21/089

USPC ..... 418/181, 238, 244–245, 259, 260, 268; 417/310, 902

See application file for complete search history.

(56) References Cited

U.S. PATENT DOCUMENTS 4,815,945 A * 3/1989 Nakajima ..... F04C 14/223 417/310

5,332,375 A * 7/1994 Kuechler ..... F01C 21/089 418/235

2015/0010415 A1* 1/2015 Yamada ..... F04D 25/026 417/420

FOREIGN PATENT DOCUMENTS

| | | | |
|---|---|---|---|
| JP | H08-219032 | A | 8/1996 |
| JP | 10-306783 | A | 11/1998 |
| JP | 3370413 | A | 11/2002 |
| JP | 2004-275781 | A | 10/2004 |
| KR | 10-1990-0004609 | B1 | 6/1990 |
| KR | 10-2006-0051788 | A | 5/2006 |
| KR | 10-1148729 | B | 5/2012 |
| KR | 10-2016-0028604 | A | 3/2016 |

OTHER PUBLICATIONS

KR Office Action dated Aug. 26, 2016 as received in Application No. 10-2016-0026096.

KR Office Action dated Oct. 20, 2016 as received in Application No. 10-2016-0026096.

* cited by examiner

[FIG. 1]
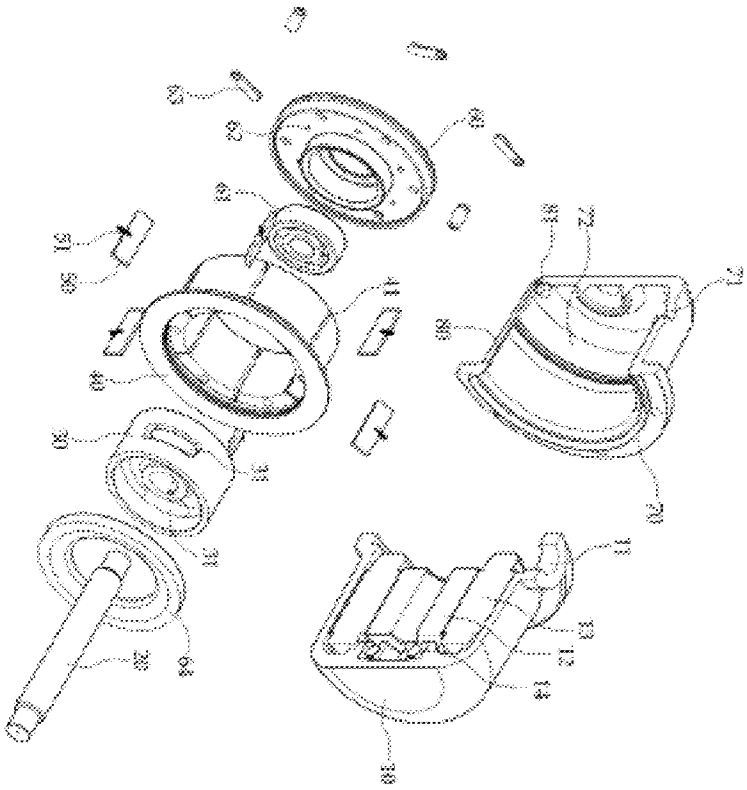

[FIG. 2]
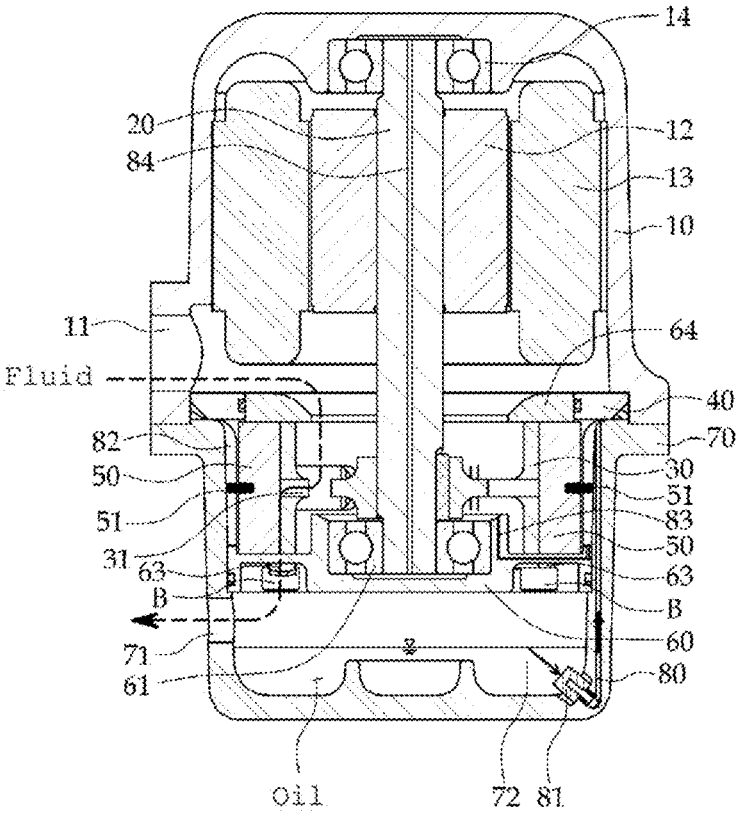
[FIG. 3]
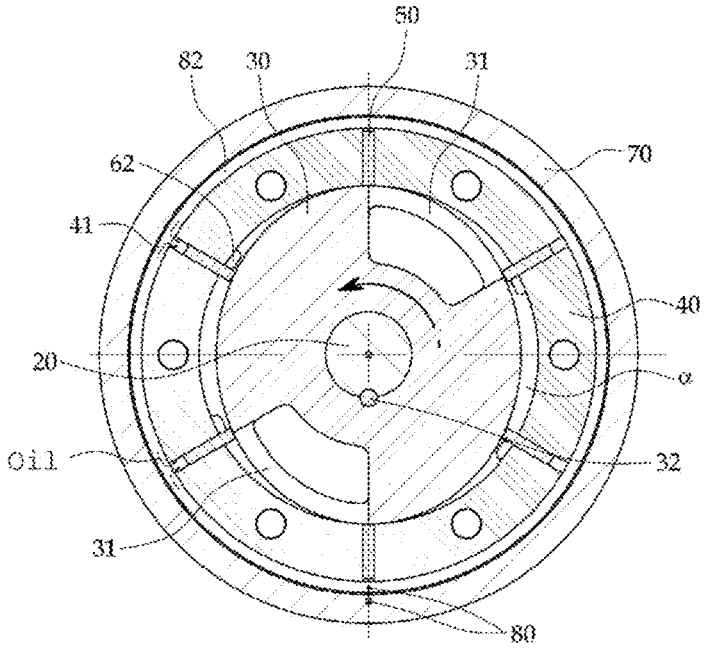

[FIG. 4]
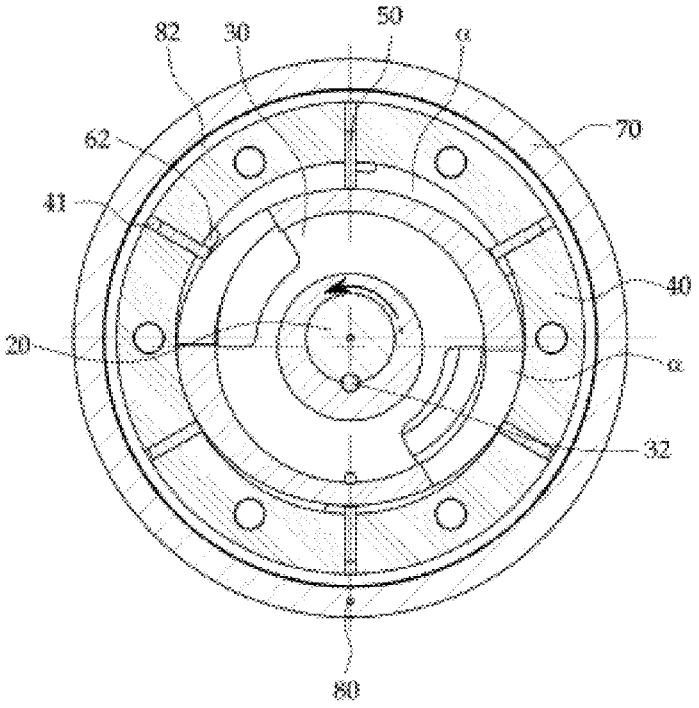
[FIG. 5]
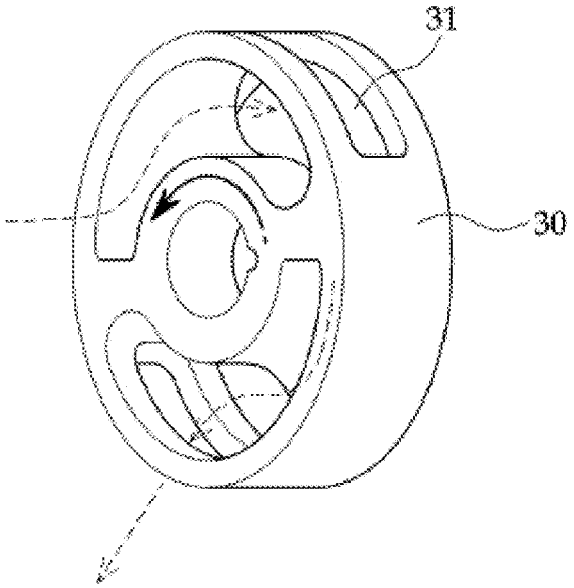

[FIG. 6]
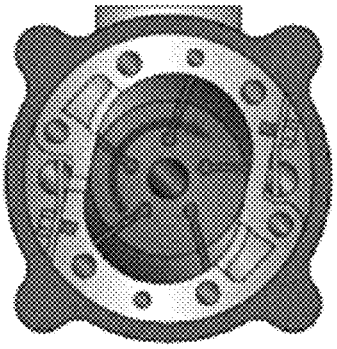
(a)
Prior Art
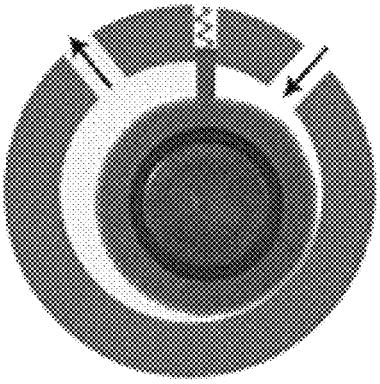
(b)
Prior Art

CENTRIFUGAL SUCTION-TYPE HYBRID VANE FLUID MACHINE

TECHNICAL FIELD

The present invention relates to a centrifugal suction-type hybrid vane fluid machine such as a compressor, a liquid pump, a vacuum pump, a blower etc.

DESCRIPTION OF THE RELATED ART

A rotory vane compressor and a rotory compressor are widely used as a compressed fluid machine for a vehicle etc.

The rotory vane compressor is configured to have a compression space separated by vanes between a cylindrical rotor into which vanes are inserted and a cylinder outside the rotor, such that fluid is discharged as the compression space becomes smaller according to the rotation of the rotor.

Such a rotory vane compressor, as illustrated in FIG. 6A, has little torque oscillation and pulsation because it includes a plurality of vanes. However, the vanes rotate. Accordingly, when the vanes rotate faster, the centrifugal force of the vanes becomes larger. This leads to an increase in the load and friction loss of a sliding part between the vanes and the cylinder. In particular, high-speed rotation of the vanes lowers efficiency.

Additionally, the rotory compressor (rolling piston) includes a circular cylinder, a roller fitted into a crank shaft, eccentrically rotating around the rotation center inside the circular cylinder so as to rotate, vanes pushed towards the surface of the roller by a spring so as to allow intake parts and discharge parts to be partitioned, suction pipes into which gas is sucked, and discharge holes blocked by valve plates consisting of an elastic material.

When it comes to such a conventional rotory compressor (rolling piston), as illustrated in FIG. 6B, the vanes do not rotate but reciprocate. Accordingly, centrifugal force is not exerted on the vanes. However, compression is performed once when this conventional rotory compressor rotates once. As a result, torque oscillation and pulsation frequently happen.

DETAILED DESCRIPTION OF THE INVENTION

Technical Problems

As a means to solve the above-described problems, provided is a centrifugal suction-type hybrid vane fluid machine which includes one or more intake openings formed at a cam ring therein, a separate oil passage used for oil to perform the function of sealing and exert backpressure on vanes, the same number of fluid discharge openings as fluid chambers or the vanes so as to improve efficiency of a compressor, a cam ring eccentrically coupled and rotating so as to improve rotatability and adhesion, thereby making it possible to minimize fluid leakage, reduce torque oscillation and pulsation, and reduce friction loss of sliding parts between the vanes and cylinder by exerting no centrifugal force on the vanes.

Other purposes and advantages of the present invention will be described below and will become apparent from the embodiments of the present invention. Further, the purposes and advantages of the present invention may be realized through the means and configuration in the appended claims.

Technical Solutions

As a means to solve the above-described problems, a centrifugal suction-type hybrid vane fluid machine includes:

a rotational shaft 20 rotatably installed by a rotation means; a cam ring 30 fixedly coupled to the rotational shaft 20 so as to rotate together with the rotational shaft 20; a cylinder 40 which has the cam ring 30 coupled to the rotational shaft 20 and installed therein, which has a plurality of vane grooves 41 cut towards the installed camp ring 30, and which has an inner peripheral edge one or more outer peripheral edges of the cam ring 30 contacts; vanes 50 which correspond to and are inserted into the plurality of vane grooves 41 of the cylinder 40, and whose one end corresponds to and contact the outer peripheral edge of the cam ring 30 so as to partition a space between the cam ring 30 and the cylinder 40 and to form a plurality of fluid chambers α; a main flange 60 and a secondary flange 64 which correspond to and are coupled to both ends of the cylinder 40 so as to form the fluid chambers α, together with the inner peripheral edge of the cylinder 40, the outer peripheral edge of the cam ring 30, and the vanes 50 allowing the plurality of fluid chambers α to be partioned; a main casing 70 which has the rotational axis 20, the cam ring 30, the cylinder 40, the vanes 50 and the main flange 60 installed therein, and which allows fluid discharged from each of the fluid chambers α to be discharged outwards; and intake openings, which allow fluid to be sucked into the fluid chambers α and rotate, installed at the outer peripheral edge of the cam ring 30.

Advantageous Effects

As described above, the present invention has the advantages of a rotory vane compressor capable of easily installing a plurality of fluid chambers and having less torque oscillation and pulsation, and a rotory compressor capable of reducing friction loss of vanes and a cylinder by exerting no centrifugal force on the vanes. Accordingly, a centrifugal suction-type hybrid vane fluid machine of the present invention is more efficient than a conventional compressor.

Further, even when rotating at high speed, a centrifugal suction-type hybrid vane fluid machine of the present invention does not cause an increase in friction loss of vanes. Accordingly, the present invention is advantageous to manufacture a small high-speed fluid machine that incurs low manufacturing costs.

Further, a centrifugal suction-type hybrid vane fluid machine of the present invention does not cause suction resistance that happens when fluid is sucked, thereby improving efficiency.

BRIEF DESCRIPTION OF THE DRAWINGS

FIG. 1 is an exploded perspective view illustrating a centrifugal suction-type hybrid vane fluid machine according to an embodiment of the present invention.

FIG. 2 is a cross section illustrating a centrifugal suction-type hybrid vane fluid machine according to an embodiment of the present invention in the axial direction.

FIG. 3 is a perpendicular cross section illustrating a state where a cam ring is installed on the same axis as a rotational shaft, when it comes to a centrifugal suction-type hybrid vane fluid machine according to an embodiment of the present invention.

FIG. 4 is a perpendicular cross section illustrating a state where a cam ring is installed eccentrically with respect to a rotational shaft, when it comes to a centrifugal suction-type hybrid vane fluid machine according to an embodiment of the present invention.

FIG. 5. is a perspective view illustrating an intake opening of a cam ring, which is capable of reducing suction resistance of sucked fluid and of improving suction efficiency by means of the centrifugal force of sucked fluid.

FIG. 6 is a view illustrating a conventional rotory vane compressor and a conventional rotory compressor.

| <Description of the Symbols> | |
|---|---|
| 10: Secondary casing | 11: First intake opening |
| 12: Rotor | 13: Stator |
| 14: Secondary bearing | 20: Rotational shaft |
| 30: Cam ring | 31: Final intake opening |
| 32: Pin | 40: Cylinder |
| 41: Vane groove | 50: Vane |
| 51: Elastic member | 60: Main flange |
| 61: Main bearing | 62: First discharge opening |
| 63: Discharge valve | 64: Secondary flange |
| 70: Main casing | 71: Final discharge opening |
| 72: Oil separating tank | 80, 84: Oil passage |
| 81: Filter | 82: Backpressure passage |
| 83: Oil supplying passage | |
| B: Fixing means | α: Fluid chamber |

MODE FOR CARRYING OUT THE INVENTION

The present invention will be described in detail with reference to embodiments of the present invention. However, the configuration and arrangement of elements described in the detailed description of the invention or illustrated in the drawings may be embodied and modified in different forms. Accordingly the configuration and arrangement of the elements should not be limited to the embodiments set forth below. Further, terms of "front", "back", "up", "down", "top", "bottom", "left", "right", "lateral" etc., set forth herein to describe a direction of a device or an element, are used to make the description of the present invention simple. Accordingly, the terms do not mean the device or the element is positioned in a certain direction. Further, it should be understood that the terms "first", "second", used to describe the present invention in the present specification and the appended claims, do not mean being relatively important or are not intended to express importance.

As a means to achieve the above-described purposes, the present invention is characterized as follows.

Below, the preferred embodiments the present invention will be described in detail with reference to the attached drawings. All the terms or words used throughout the specification and claims should not be interpreted as those defined in commonly used dictionaries but should be interpreted as chose having a meaning and concept that are consistent in the context of the technical spirit of the present invention under the principle that the inventor may properly define the concept of terms so as to describe the inventor's invention the most preferred way.

The embodiments described in the specification and the configurations illustrated in the drawings are provided only as examples. Accordingly, the scope of the present invention should not be limited to the embodiments set forth herein. Further, it should be understood that various equivalents and modifications that can replace the embodiments and configurations may exist at the time of filing this application.

According to an embodiment of the present invention, a centrifugal suction-type hybrid vane fluid machine includes: a rotational shaft 20 rotatably installed by a rotation means; a cam ring 30 fixedly coupled to the rotational shaft 20 so as to rotate together with the rotational shaft 20; a cylinder 40 which has the cam ring 30 coupled to the rotational shaft 20 and installed therein, which has a plurality of vane grooves 41 cut towards the installed camp ring 30, and which has an inner peripheral edge one or more outer peripheral edges of the cam ring 30 contacts; vanes 50 which correspond to and are inserted into the plurality of vane grooves 41 of the cylinder 40, and whose one end corresponds to and contact the outer peripheral edge of the cam ring 30 so as to partition a space between the cam ring 30 and the cylinder 40 and to form a plurality of fluid chambers α; a main flange 60 and a secondary flange 64 which correspond to and are coupled to both ends of the cylinder 40 so as to form the fluid chambers α, together with the inner peripheral edge of the cylinder 40, the outer peripheral edge of the cam ring 30, and the vanes 50 allowing the plurality of fluid chambers α to be partioned; a main casing 70 which has the rotational axis 20, the cam ring 30, the cylinder 40, the vanes 50 and the main flange 60 installed therein, and which allows fluid discharged from each of the fluid chambers α to be discharged outwards; and intake openings, which allow fluid to be sucked into the fluid chambers α and rotate, installed at the outer peripheral edge of the cam ring 30.

Further, at least one final intake opening 31 is formed at the cam ring 30. The sucked fluid rotates by means of the rotation of the cam ring 30 because of the final intake opening 31 formed at the outer peripheral edge of the cam ring 30, and the centrifugal force generated by the rotating fluid increases the suction efficiency of fluid sucked into the fluid chambers α.

Further included is a backpressure passage 82 which is formed between the main casing 70 and the cylinder 40 such that oil separated by an oil separating tank 72 moves along an oil passage 80 to the backpressure passage 82 and that the oil moved to the backpressure passage 82 lubricates portions into which the vanes 50 are inserted while performing the function of sealing so as to prevent fluid from leaking into another part except the fluid chambers α, and exerts backpressure so as to push the vanes 50 against the outer peripheral edge of the cam ring 30 at a preset, consistent pressure all the time, thereby making the vanes 50 contact the cam ring 30 all the time.

Further, the main flange 60 includes a plurality of first discharge openings 62 and discharge valves 63 installed at each of the plurality of first discharge openings 62, and the number of the first discharge openings 62 and the number of the discharge valves 63 are the same as the number of the fluid chambers α or the number of the vanes 50.

Further, the cam ring 30 is installed on the same axis as the rotational shaft 20 or installed eccentrically with respect to the rotational shaft 20, and if a plurality of first intake openings 11 are formed at the cam ring 30 to face each other, volume of the fluid chambers α formed at each of the first intake openings 11 differs, such that the outer peripheral edge of the cam ring 30 and the inner peripheral edge of the cylinder 40 may come into close contact with each other, thereby minimizing leakage of fluid.

Below, a centrifugal suction-type hybrid vane fluid machine according to a preferred embodiment of the present invention will be described in detail with reference to FIGS. 1 to 5.

A centrifugal suction-type hybrid vane fluid machine according to the present invention, which includes a secondary casing 10, a rotational shaft 20, a cam ring 30, a cylinder 40, vanes 50, a main flange 60, and a main casing 70, includes a rotational shaft 20, a cam ring 30 which is fixed to the rotational shaft 20 and rotates, a plurality of vanes 50 which contact the outer peripheral edge of the cam ring 30, a cylinder 40 which contacts one or more portion of the outer peripheral edge of the cam ring 30 and where the vanes 50 are inserted into the plurality of the bane grooves 41, a main flange 60 which is fixed to a lateral surface of the cylinder 40 and the inside of a main casing 70, where a plurality of first discharge openings 62 are formed, and where discharge valves 63 are installed at each of the first discharge openings 62, and a secondary flange 64 which is fixed to the other lateral surface of the cylinder 40, wherein fluid chambers α are formed by the outer peripheral edge of the cam ring 30, the inner peripheral edge of the cylinder 40, the vanes 50, the main flange 60 and the secondary flange. As the cam ring 30 rotate, the volume of the fluid chambers increases and decreases.

The secondary casing 10 has a pipe shape whose inside is hollow like the main casing 70 and is configured as a compressor.

The secondary casing 10 and the main casing 70 are coupled to each other and have the rotational shaft 20, the cam ring 30, the cylinder 40, the vanes 50, the main flange 60 etc., which will be described hereunder, therein.

First intake openings 11 into which fluid flows first time are formed at the outer peripheral edge of the secondary casing 10, and final discharge openings 71, which discharge fluid after the fluid flows into the secondary casing 10 and passes inner elements, are formed at the main casing 70.

Additionally, the secondary casing 10 includes a rotor 12 and stator 13 respectively so as to rotate the rotational shaft 20 inside the secondary casing, a secondary bearing 14 is installed at one end of the secondary casing 10, a main bearing 61 is formed at the main flange 60 installed inside the main casing 70, such that both ends of the rotational shaft 20 that rotates inside the machine of the present invention are coupled.

The rotational shaft 20, as described above, is rotatably installed perpendicularly inside the secondary casing 10 and the main casing 70 that are coupled to each other.

The cam ring 30 is integrally installed at the outer peripheral edge of the rotational shaft 20 so as to rotate together with the rotational shaft 20, has a hole which penetrates the center of the cam ring and into which the rotational shaft 20 is inserted, and has final intake openings 31 which are formed from the inner peripheral edge towards the outer peripheral edge of the cam ring such that the fluid introduced through the first intake openings 11 of the above-described secondary casing 10 moves from the inside towards the outside of the machine through the first intake openings 11 after flowing into the cam ring 30.

As described above, according to the present invention, one or more intake openings (final intake openings 31) penetrating the inner peripheral edge and the outer peripheral edge of the cam ring 30 are formed (in an embodiment of the present invention, a plurality of intake openings are formed to face each other). In this case, fluid is sucked from the inner peripheral edge of the cam ring 30 towards the outer peripheral edge thereof, and as the cam ring 30 rotates, the sucked fluid also rotates so as to generate centrifugal force, and the suction pressure of the sucked fluid increases as much as the centrifugal force such that fluid may be sucked into the fluid chambers α more easily. Further, if liquid is used as fluid like a pump for liquid, cavitation caused by suction resistance in the fluid chambers can be effectively inhibited.

Suction resistance of fluid causes lower efficiency in all sorts of fluid devices. However, according to the present invention, intake openings, as described above, may be large in size. Accordingly, suction resistance that happens when fluid is sucked into the fluid chambers α may be avoided.

The cylinder 40 is configured to have a cross section of a ring with a certain width and depth, and such a cylinder 40 has a structure where a plurality of cut grooves—i.e. vane grooves 41—are cut towards the inner peripheral edge thereof at regular intervals so as to form the vane grooves along the inner peripheral edge thereof.

Surely, the main flange 60 and the secondary flange 64 that will be described hereunder are respectively coupled to both ends of the cylinder 40 with a fixing means (bolts etc. B) and then installed inside the main casing 70.

Further, the cam ring 30, where a pin 32 and the rotational shaft 20 are inserted and rotate, is installed inside the cylinder 40 with the above-described structure. Fluid, which is sucked by a plurality of final intake openings 31 while the cam ring 30 rotates, moves to the fluid chambers α between the plurality of vanes 50 that correspond to and fit into the vane grooves 41 between the inner peripheral edge of the cylinder 40 and the outer peripheral edge of the cam ring 30 and that are contacted by the cam ring 30.

If six vane grooves 41 are formed at the cylinder 40, six vanes 50 correspond to and fit into each of the vane grooves 41. By doing so, the vanes 50 protrude towards the inner peripheral edge of the cylinder 40 and contact the outer peripheral edge of the cam ring 30 such that six fluid chambers α, a space between a vane 50 and a vane 50, are formed.

The vanes 50, as illustrated above, are respectively coupled to the plurality of vane grooves 41 formed at the cylinder 40, wherein one end of each of the vanes is inserted into the vane groove in the state where one end of each of the vanes is coupled to an elastic member (e.g. spring 51) such that the plurality of vanes 50 are pushed towards the outer peripheral edge of the cam ring 30 in the vane grooves 41 by means of the elasticity of the elastic members 51 fixed to the inner peripheral edge of the main casing 70, and contact the outer peripheral edge of the cam ring 30 all the time.

The main bearing 61, into which one end of the rotational shaft 20 is inserted, is formed at the center of one surface of the main flange 60, on which the cylinder 40 is put, and a plurality of first discharge openings 62 (e.g. six first discharge openings) corresponding to the fluid chambers α—i.e. a space between a vane 50 and a vane 50—are formed along the circumferential surface of one surface of the main flange 60, at which the main bearings 61 are formed.

Accordingly, fluid moved to a fluid chamber α between a vane 50 and a vane 50 passes a first discharge opening 62 connected to the fluid chambers out of the plurality of first discharge openings 62 of the main flange 60.

Surely, discharge valves 63 corresponding to each of the first discharge openings 62 are separately installed on the other surface of the main flange 60. That is, the first discharge openings 62 and discharge valves 63 are installed at the main flange, and the number of the discharge openings 62 and discharge valves 63 is the same as that of the fluid chambers α (the number of the vanes 50), and the main flange 60, where the secondary flange 64 and the main bearing 61 are respectively inserted into one end and the other end of the cylinder 40, is fixed together with each of the discharge valves 63 by means of fixing means B.

According to the present invention with the above-described configuration, the first discharge openings 62 and the discharge valves 63 are easily installed. Additionally, over-compression (the case where pressure compressed in a fluid chamber α is higher than that of a final discharge) does not occur because each fluid chamber α is provided with the first discharge opening 62 and the discharge valve 63, thereby improving efficiency in a compressor, reducing wear caused by increased load, and preventing liquid compression (a phenomenon where liquid is compressed in a fluid chamber if a refrigerant is sucked into the fluid chamber in the state where the refrigerant is liquefied, which is a cause for a breakdown of a compressor).

As described above, the cylinder 40 and the main flange 60 are installed in the main casing 70, and a separate space is prepared at the lower end of the main casing 70 in which the main flange 60 is installed, such that an oil separating tank 72 is formed.

By doing so, the oil separating tank 72 separates oil from fluid having passed the first discharge opening 62 of the main flange 60, and the fluid is discharged through the final discharge opening 71 outwards.

In other words, the fluid chambers α are formed by the outer peripheral edge of the cam ring 30, the inner peripheral edge of the cylinder 40, the main flange 60, the secondary flange 64, and each of the vanes 50. When the rotor 12 rotates, the cam ring 30 rotates by means of the rotational shaft 20, and the volume of the fluid chambers increases and decreases.

That is, if the volume of the fluid chambers α increases, the fluid sucked through the first intake opening 11 passes a vacant space between the secondary flange 64 and the rotational shaft 20 and then is sucked into the fluid chambers α through the inside of the cam ring 30 and the final intake opening 31 formed at the cam ring 30. If the volume of the fluid chambers α decreases, the sucked fluid is compressed (or the pressure thereof increases). The compressed fluid is transferred through the first discharge opening 62 and the discharge valve 63 (check valve) to the oil separating tank 72, and the oil separating tank separates oil from the transferred fluid, and then the fluid is discharged through the final discharge opening 71 out of the fluid machine of the present invention.

Additionally, an oil passage 80 is formed to be dented at the inner peripheral edge of the main casing 70 from the oil separating tank 72 in the lengthwise direction of the main casing. The oil separated by the oil separating tank 72 moves through the oil passage 80 between the cylinder 40 and the main casing 70, and seals portions into which the vanes 50 are inserted so as to prevent fluid from leaking into another part except the fluid chambers α, and exerts backpressure so as to push the vanes 50 against the outer peripheral edge of the cam ring 30 at a preset pressure all the time such that the vanes 50 contact the cam ring 30 all the time.

Surely, a filter 81 is installed at one end of the oil separating tank 72 such that the oil moves after foreign substances are removed from the oil by the filter. The oil separated by the oil separating tank 72 moves to a backpressure passage 82 through the filter 81 and the oil passage 80 so as to reduce friction at a sliding part (contacted part) of the vanes 50, performs the function of sealing and exerts backpressure on the vanes 50.

Further, a small amount of oil diverged by the backpressure passage 82 is supplied to the main bearing 61 through an oil supplying passage 83, the oil supplied to the main bearing 61 is supplied to the secondary bearing 14 through the oil passage 80 of the rotational shaft 20 and then drops such that some part of the oil is supplied to the sliding part of the flanges (main flange 60 and secondary flange 64) and that the other part of the oil is sucked by the final intake opening 31, is discharged through the first discharge opening 62 together with the fluid to the oil separating tank 72 and circulates in the compressor.

In other words, the oil passage 80 connected with the vane grooves 41 is formed between the outer peripheral edge of the cylinder 40 and the main casing 70, and the high-pressure oil separated by the oil separating tank 72 of the main casing exerts backpressure on the vanes 50 while moving to the backpressure passage 82 through the oil passage 80. The oil is easily supplied to the sliding parts (the vane grooves 41 and vanes 50 of the cylinder 40, the main flange 60 and the secondary flange 64 and vanes 50) while exerting backpressure on the vanes 50 thereby reducing friction on the sliding parts (contacted surfaces), sealing the gap of the sliding parts and reducing internal leakage of fluid.

Additionally, in the case of the present invention, the cam ring 30 rotating inside may be installed on the same axis as the rotational shaft 20 while the cam ring 30 may be eccentrically installed with respect to the rotational shaft 20 or the cylinder 40. If the cam ring 30 is eccentrically installed with respect to the rotational shaft 20, the volume and pressure of the fluid chambers α at both sides of the cam ring 30 are different such that the cam ring 30 is pushed from a side of high pressure to a side of low pressure. Accordingly, the outer peripheral edge of the cam ring 30 and the inner peripheral edge of the cylinder 40 comes into close contact with each other thereby reducing fluid leakage, and discharge, as illustrated in FIG. 3, is not carried out simultaneously thereby reducing pulsation.

The present invention has been described with reference to the embodiments and drawings but is not limited to the embodiments and drawings set forth herein. It should be understood that the present invention may be modified and changed in various forms by one of ordinary skill in the art to which the present invention pertains without departing from the technical spirit of the present invention and the scope of the appended claims.

The invention claimed is:

1. A centrifugal suction-type hybrid vane fluid machine comprising:

a secondary housing having a rotor and a stator for rotating a rotational shaft installed in the second housing;

a cam ring fixedly coupled to the rotational shaft so as to rotate together with the rotational shaft;

a cylinder which has the cam ring coupled to the rotational shaft and installed therein, which has a plurality of vane grooves cut towards the installed camp ring, and which has an inner peripheral edge one or more outer peripheral edges of the cam ring contacts;

vanes which correspond to and are inserted into the plurality of vane grooves of the cylinder, and whose one end corresponds to and contact the outer peripheral edge of the cam ring so as to partition a space between the cam ring and the cylinder and to form a plurality of fluid chambers;

a main flange and a secondary flange which correspond to and are coupled to both ends of the cylinder so as to form the fluid chambers, together with the inner peripheral edge of the cylinder, the outer peripheral edge of the cam ring, and the vanes allowing the plurality of fluid chambers to be partitioned;

a main casing which has the rotational shaft, the cam ring, the cylinder, the vanes and the main flange installed therein, and which allows fluid discharged from each of the fluid chambers to be discharged outwards; and intake openings, which allow fluid to be sucked into the fluid chambers and rotate, installed at the outer peripheral edge of the cam ring and that rotates.

2. The centrifugal suction-type hybrid vane fluid machine according to claim 1, wherein:

the cam ring comprises at least one final intake opening formed at the cam ring, sucked fluid rotates while the cam ring rotates because of the final intake opening formed at the outer peripheral edge of the cam ring, and a centrifugal force generated by the rotating fluid increases the suction efficiency of fluid sucked into the fluid chambers.

3. The centrifugal suction-type hybrid vane fluid machine according to claim 1, wherein:

a backpressure passage is further formed between the main casing and the cylinder such that oil separated by an oil separating tank moves along an oil passage to the backpressure passage and that the oil moved to the backpressure passage lubricates portions into which the vanes are inserted while performing the function of sealing so as to prevent fluid from leaking into another part except the fluid chambers, and exerts backpressure so as to push the vanes against the outer peripheral edge of the cam ring at a preset, consistent pressure all the time, thereby making the vanes contact the cam ring all the time.

4. The centrifugal suction-type hybrid vane fluid machine according to claim 1, wherein:

the main flange comprises a plurality of first discharge openings and discharge valves installed at each of the plurality of first discharge openings, and the number of the first discharge openings and the number of the discharge valves are the same as the number of the fluid chambers ($\alpha$) or the number of the vanes.

5. The centrifugal suction-type hybrid vane fluid machine according to claim 1, wherein:

the cam ring is installed on the same axis as the rotational shaft or installed eccentrically with respect to the rotational shaft, and when a plurality of first intake openings are formed at the cam ring to face each other, volume of the fluid chambers ($\alpha$) formed at each of the first intake openings differs such that the one or more outer peripheral edge of the cam ring and the inner peripheral edge of the cylinder come into close contact with each other, thereby minimizing leakage of fluid.

* * * * *